US011834255B2

(12) United States Patent
Zou et al.

(10) Patent No.: US 11,834,255 B2
(45) Date of Patent: Dec. 5, 2023

(54) LIGHT DEVICE HOLDER

(71) Applicant: XIAMEN LEEDARSON LIGHTING CO., LTD, Fujian (CN)

(72) Inventors: Yuanlong Zou, Fujian (CN); Ruixiu Hou, Fujian (CN); Qidi Huang, Fujian (CN); Yinghong Yao, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/355,072

(22) Filed: Jun. 22, 2021

(65) Prior Publication Data

US 2022/0402686 A1 Dec. 22, 2022

(51) Int. Cl.

| | |
|---|---|
| ***B65D 85/42*** | (2006.01) |
| ***B65D 5/02*** | (2006.01) |
| ***B65D 5/48*** | (2006.01) |

(52) U.S. Cl.

CPC ..... *B65D 85/42* (2013.01); *B65D 5/0254* (2013.01); *B65D 5/48014* (2013.01)

(58) Field of Classification Search

CPC .. B65D 85/42; B65D 5/0254; B65D 5/48014; B65D 5/48016; B65D 5/5014; B65D 2201/00

USPC ..... 206/422, 421, 419, 420

See application file for complete search history.

(56) References Cited

U.S. PATENT DOCUMENTS

| | | | | |
|---|---|---|---|---|
| 1,758,568 | A * | 5/1930 | Finley | B65D 5/5059 206/418 |
| 2,611,529 | A * | 9/1952 | Currivan | B65D 5/5016 206/593 |
| 2,846,131 | A * | 8/1958 | Struble | B65D 5/48014 229/120.12 |
| 3,806,022 | A * | 4/1974 | Gustafsson | B65D 5/48014 206/422 |
| 4,215,779 | A * | 8/1980 | Vajtay | B65D 85/42 206/421 |
| 4,498,580 | A * | 2/1985 | Getz | B65D 5/5016 206/592 |
| 6,135,283 | A * | 10/2000 | Huang | B65D 85/42 206/419 |
| 7,874,427 | B2 * | 1/2011 | Hardy | B65D 71/26 206/419 |
| 2016/0362220 | A1 * | 12/2016 | Kearns | B65D 5/4204 |
| 2019/0039779 | A1 * | 2/2019 | Hengami | B65D 5/4279 |

* cited by examiner

*Primary Examiner* — J. Gregory Pickett
*Assistant Examiner* — Jenine Pagan
(74) *Attorney, Agent, or Firm* — Chun-Ming Shih; LANWAY IPR SERVICES

(57) ABSTRACT

A light device holder includes a first paper wall, a second paper wall, a first lateral wall, a second lateral wall and a spacer plate. The light device holder is designed containing and enclosing multiple light bulbs. The second paper wall is opposite to the first paper wall. Two sides of the first paper wall and the second paper wall are respectively connected to edges of the first lateral wall and the second lateral wall forming a rectangular container space. The spacer plate has a first plate part and a second plate part. The first plate part engages an inner surface of the first paper wall. The second plate part is folded from the first plate part to extend as a tilt surface to divide the rectangular container space into a first space part and a second space part.

18 Claims, 22 Drawing Sheets

LIGHT DEVICE HOLDER

FIELD

The present invention is related to a light device holder, and more particularly related to a light device holder paper for storing multiple light devices with a compact size.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It takes effort to deliver light devices around the world. Without a convenient holder, the light devices may be damaged during transportation.

However, the cost and the size of the containers are also critical to overall cost. Therefore, it is beneficial to design a compact but reliable holder design for carrying light devices.

SUMMARY

In some embodiments, a light device holder includes a first paper wall, a second paper wall, a first lateral wall, a second lateral wall and a spacer plate.

The light device holder is designed containing and enclosing multiple light bulbs.

The second paper wall is opposite to the first paper wall.

Two sides of the first paper wall and the second paper wall are respectively connected to edges of the first lateral wall and the second lateral wall forming a rectangular container space.

The spacer plate has a first plate part and a second plate part.

The first plate part engages an inner surface of the first paper wall.

The second plate part is folded from the first plate part to extend as a tilt surface to divide the rectangular container space into a first space part and a second space part.

The first space part is symmetrical to the second space part for respectively storing two light bulbs.

In some embodiments, the two light bulbs stored in the first space part and the second space part are headed with opposition directions.

In some embodiments, the first space part has a first end and and second end.

The first end has a larger diameter than the second end.

In some embodiments, the second plate part is rotatable with respect to the first plate part to removing a second light bulb after the first light bulb is removed from the rectangular container space.

In some embodiments, the first plate part is attached to the inner surface of the first paper wall with glue.

In some embodiments, the first plate part has a triangle structure with two triangle sides aligning with two sides of the first paper wall.

In some embodiments, the light device holder may also include a top cover and a bottom cover.

The top cover and the bottom cover conceals the rectangular container space.

In some embodiments, the top cover, the bottom cover, the first paper plate, the second paper plate, the first lateral wall, the second lateral wall and the spacer plate are all formed on a single paper sheet.

In some embodiments, the first plate part and the second plate part are folded with 90 degree angles.

In some embodiments, the first plate part is fixed with respect to the first paper plate to ensure the second plate part stable when storing the light bulbs.

In some embodiments, the first paper wall has a transparent window to see the light bulbs stored in the rectangular container space.

In some embodiments, the light device holder may also include a second spacer plate with the same structure as the spacer plate for storing another two light bulbs.

In some embodiments, an elastic layer is formed on a surface of the second plate part.

In some embodiments, an adhesive layer is formed on a surface of the second plate part to decrease movement of the light bulbs.

In some embodiments, an inner electrode is disposed on the second plate part for connecting electricity from an external electrode on an exterior surface of the first lateral wall for guiding an external power to turn on the light bulbs stored in the rectangular space.

In some embodiments, an Edison socket is disposed on the second plate part for containing the inner electrode.

In some embodiments, the first lateral wall is made of a different material as the first paper wall.

In some embodiments, the material of the first lateral wall has a strong rigidity than the first paper wall.

In some embodiments, a trap hole is disposed on the second plate part for holding the light bulb.

In some embodiments, the second plate part has a main part and an extending part with a folding angle with respect the main part.

DETAILED DESCRIPTION

Figure 21:
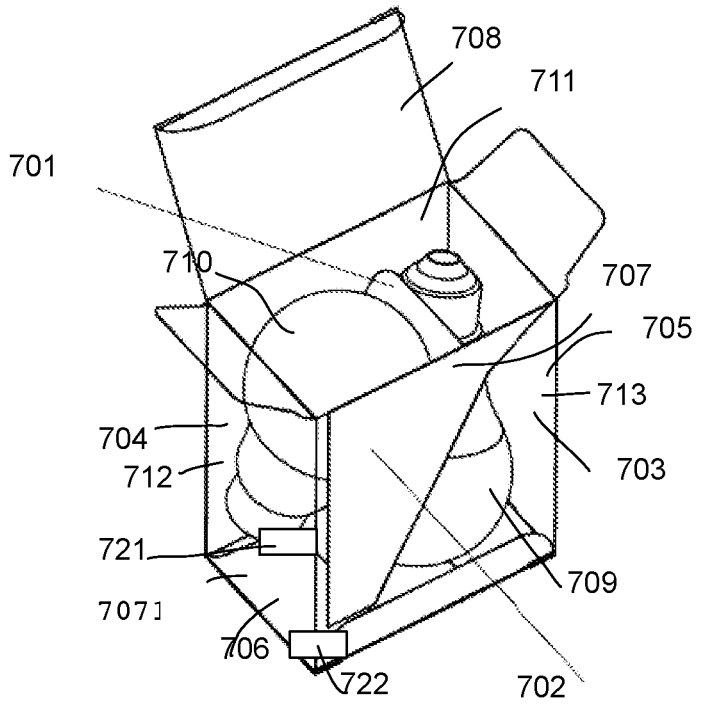
FIG. 21 shows another embodiment diagram.

In FIG. 21, a light device holder includes a first paper wall 703, a second paper wall 704, a first lateral wall 705, a second lateral wall 706 and a spacer plate 707.

The light device holder is designed containing and enclosing multiple light bulbs 709, 710.

The second paper wall 704 is opposite to the first paper wall 703.

Two sides of the first paper wall 703 and the second paper wall 704 are respectively connected to edges of the first lateral wall 705 and the second lateral wall 706 forming a rectangular container space 711.

The spacer plate 707 has a first plate part 702 and a second plate part 701.

The first plate part 702 engages an inner surface of the first paper wall 703.

The second plate part 701 is folded from the first plate part 702 to extend as a tilt surface to divide the rectangular container space into a first space part 712 and a second space part 713.

The first space part 712 is symmetrical to the second space part 713 for respectively storing two light bulbs 709, 710. In the example, the two space part together form the rectangular container space 711.

In some embodiments, the two light bulbs 709, 710 stored in the first space part 712 and the second space part 713 are headed with opposition directions. One bulb head is facing upwardly and another is facing downwardly.

In some embodiments, the first space part has a first end and and second end.

The first end has a larger diameter than the second end. In this example, the first space part has a larger diameter on the top end than the bottom end.

In some embodiments, the second plate part is rotatable with respect to the first plate part to removing a second light bulb after the first light bulb is removed from the rectangular container space. When the light bulb 710 is removed from the rectangular container space 711, the first plate part may be moved for allowing the light bulb 709 on the right side to remove from the rectangular container space 711.

In some embodiments, the first plate part 702 is attached to the inner surface of the first paper wall 703 with glue.

In some embodiments, the first plate part has a triangle structure with two triangle sides aligning with two sides of the first paper wall. For example, there is a portion of the first plate part 702 forming a triangle shape, which may be seen in FIG. 21.

In some embodiments, the light device holder may also include a top cover 708 and a bottom cover 7071.

The top cover 708 and the bottom cover 7071 conceals the rectangular container space 711.

In some embodiments, the top cover, the bottom cover, the first paper plate, the second paper plate, the first lateral wall, the second lateral wall and the spacer plate are all formed on a single paper sheet.

FIG. 1 to FIG. 10 show one such example, in which a paper sheet is folded to form the structure illustrated in FIG. 21.

FIG. 11 to FIG. 20 show another example, in which a paper sheet is folded to form another structure that contains four light bulbs.

In some embodiments, the first plate part and the second plate part are folded with 90 degree angles.

In some embodiments, the first plate part is fixed with respect to the first paper plate to ensure the second plate part stable when storing the light bulbs.

In some embodiments, the first paper wall has a transparent window to see the light bulbs stored in the rectangular container space. For example, a portion of the first paper wall and/or the second paper wall may be disposed with a transparent window so that users may see the light bulbs stored in the light device holder.

In some embodiments, the light device holder may also include a second spacer plate with the same structure as the spacer plate for storing another two light bulbs. FIG. 11 to FIG. 20 show such an example. More sets of such structures may be repeated for carrying even more light bulbs. For example, 2×2 arrays of containers may be designed in the same concept.

In some embodiments, an elastic layer is formed on a surface of the second plate part. For example, foam may be attached on the surface of the second plate part facing to the light bulbs.

In some embodiments, an adhesive layer is formed on a surface of the second plate part to decrease movement of the light bulbs. For example, some adhesive material may be applied on the surface of the second plate part for slighting attaching and fixing the light bulbs preventing the light bulbs to move during transportation. For example, the post-it glue may be applied while not leaving dirt on the surface of the light bulb.

In some embodiments, an inner electrode 721 is disposed on the second plate part for connecting electricity from an external electrode 722 on an exterior surface of the first lateral wall for guiding an external power to turn on the light bulbs stored in the rectangular space.

In some embodiments, an Edison socket is disposed on the second plate part for containing the inner electrode.

In some embodiments, the first lateral wall is made of a different material as the first paper wall.

In some embodiments, the material of the first lateral wall has a strong rigidity than the first paper wall.

Figure 22:
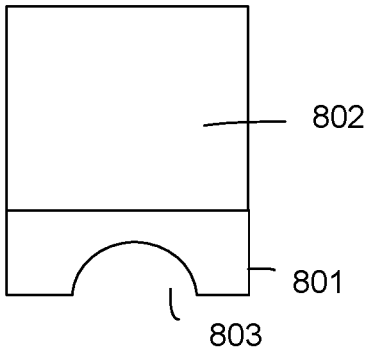
FIG. 22 shows another example in another embodiment.

In FIG. 22, a trap hole 803 is disposed on the second plate part for holding the light bulb.

In some embodiments, the second plate part has a main part 802 and an extending part 801 with a folding angle with respect the main part 802. Specifically, the extending part 801 is folded for attaching the trap hole 803 to the light bulb.

Please refer to FIG. 1 to FIG. 10.

Figure 1:
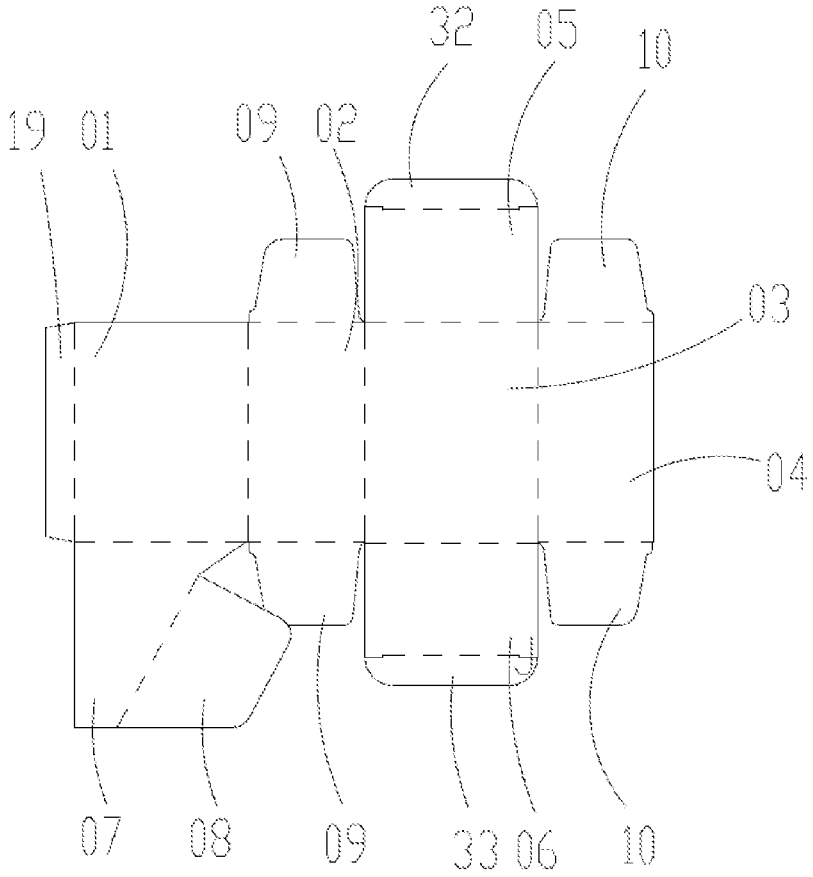
FIG. 1 illustrates an unfolded diagram of an embodiment.

In FIG. 1, a paper sheet has several areas 01, 02, 03, 04, 05, 06, 07, 08, 09, 10, 19, 33, 32. These areas are folded to form the example explained in FIG. 21.

Figure 2:
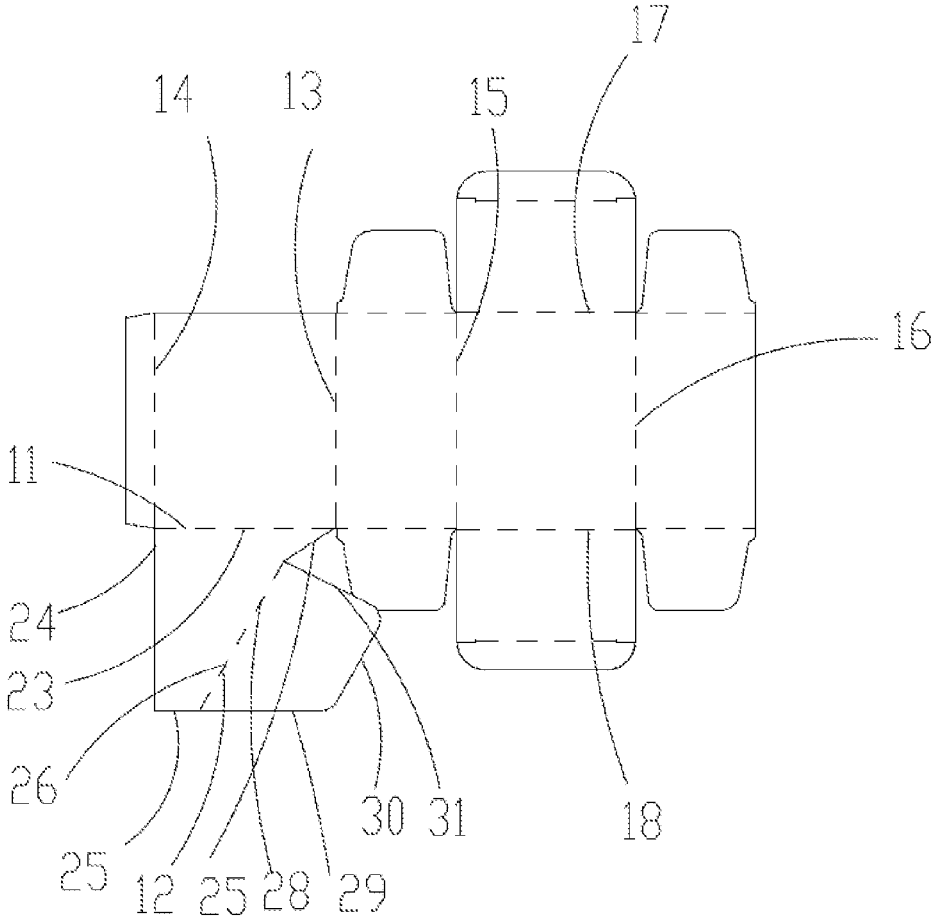
FIG. 2 illustrates another view of the example in FIG. 1.
Figure 3:
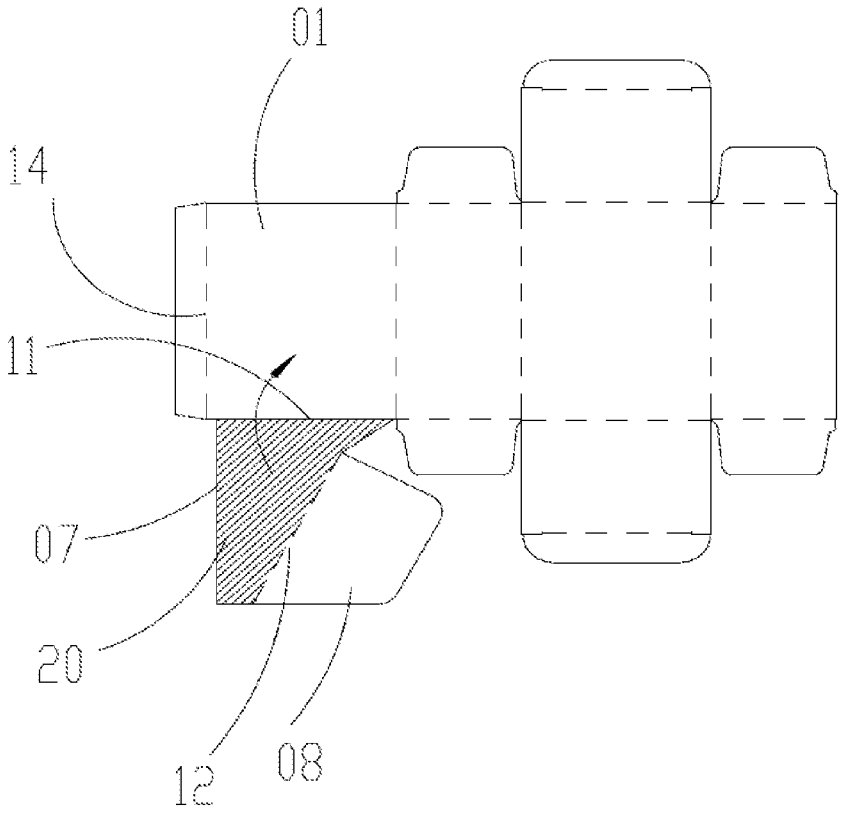
FIG. 3 illustrates a folding instruction for the example in FIG. 1.
Figure 4:
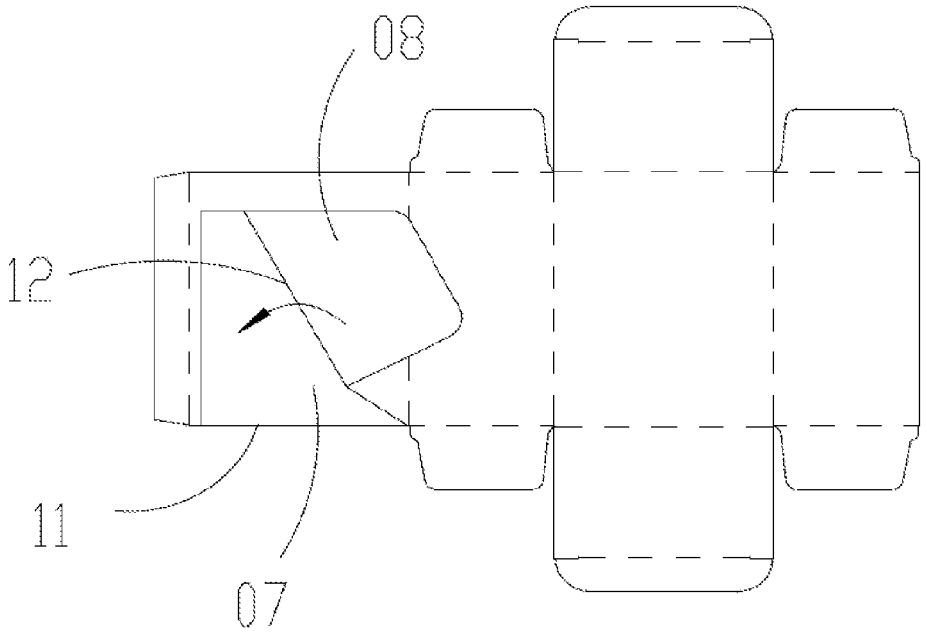
FIG. 4 illustrates a folding instruction for the example in FIG. 1.
Figure 5:
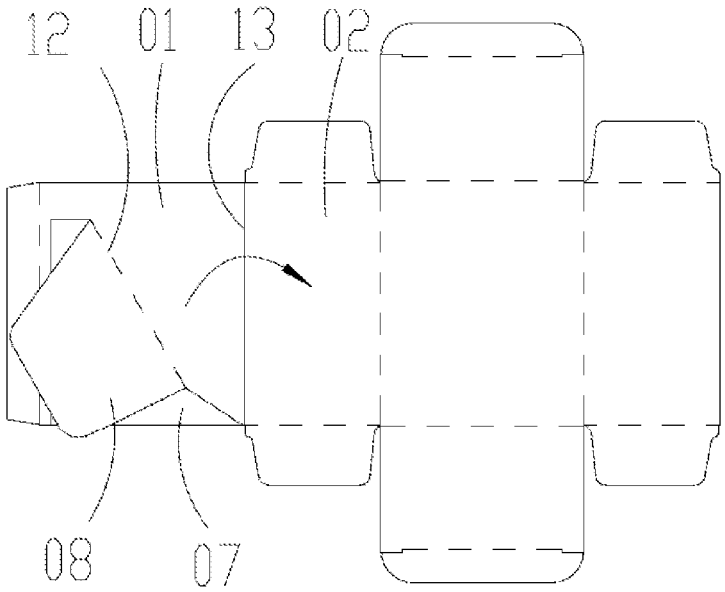
FIG. 5 illustrates a folding instruction for the example in FIG. 1.
Figure 6:
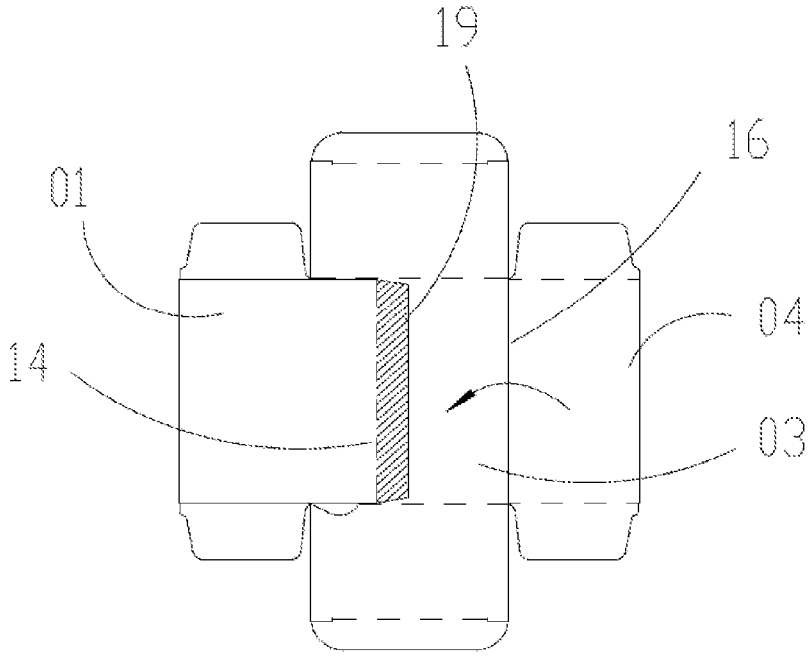
FIG. 6 illustrates a folding instruction for the example in FIG. 1.
Figure 7:
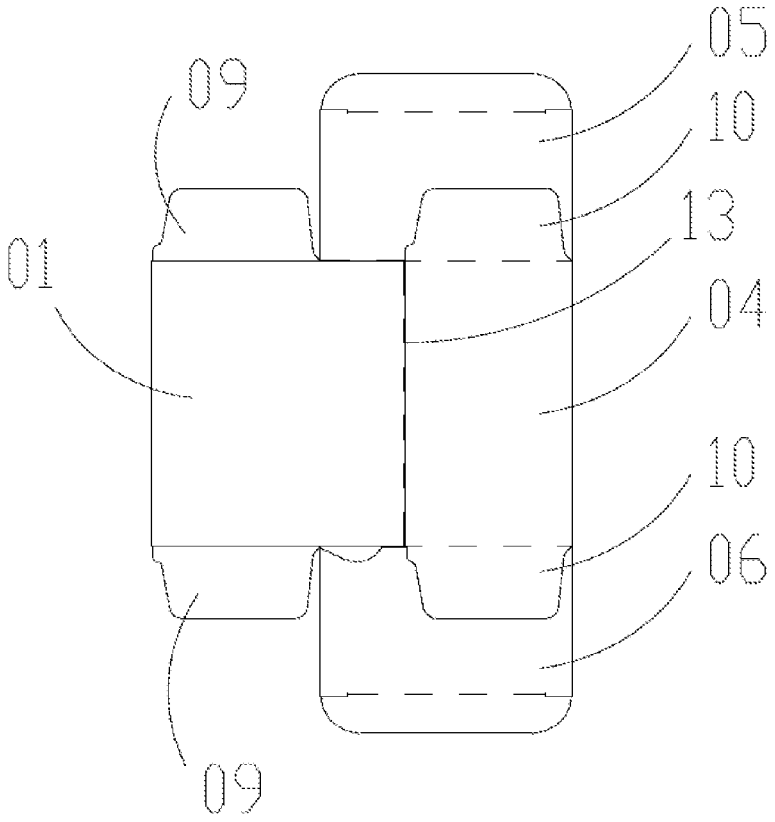
FIG. 7 illustrates a folding instruction for the example in FIG. 1.
Figure 8:
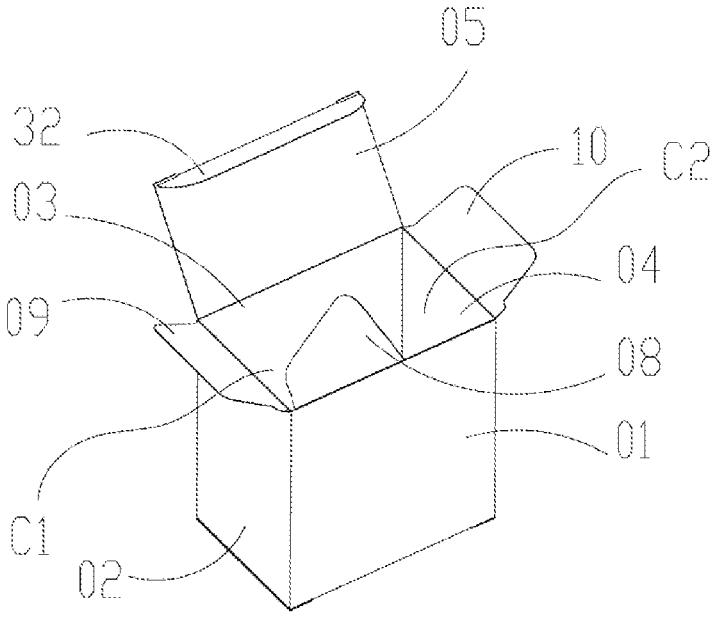
FIG. 8 illustrates a folded example ready for storing light bulbs.

FIG. 2 further shows more parts, like folding lines 14, 13, 15, 17, 16, 18, 26, 12, 28, 23, 11 and edge lines 31, 30, 29, 24, 25.

FIG. 3 to FIG. 8 show how these areas are folded along the folding lines to form a light device holder.

Figure 9:
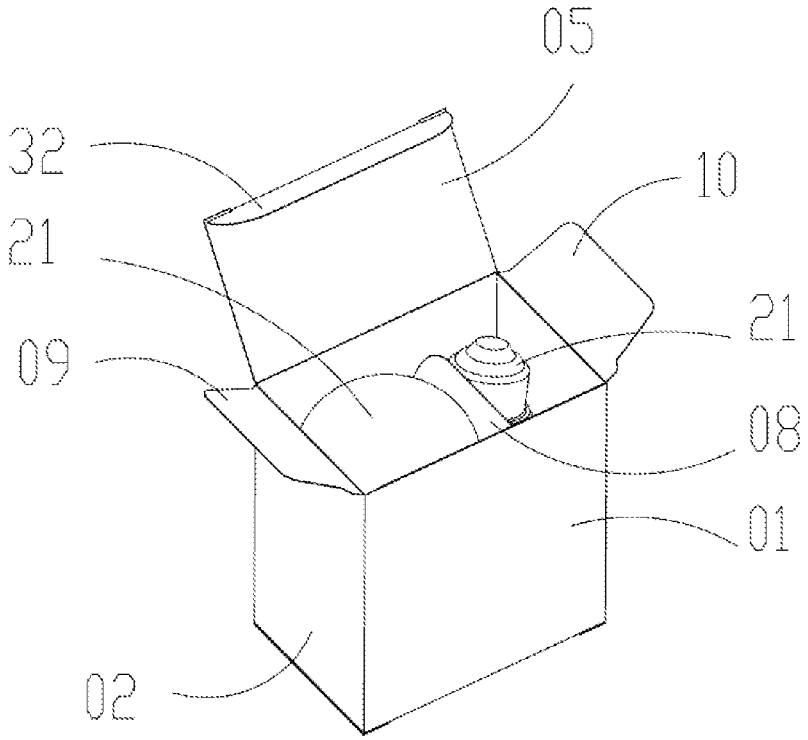
FIG. 9 illustrates a usage example showing light bulbs being stored.

FIG. 9 shows two light bulbs stored in the light device holder.

Figure 10:
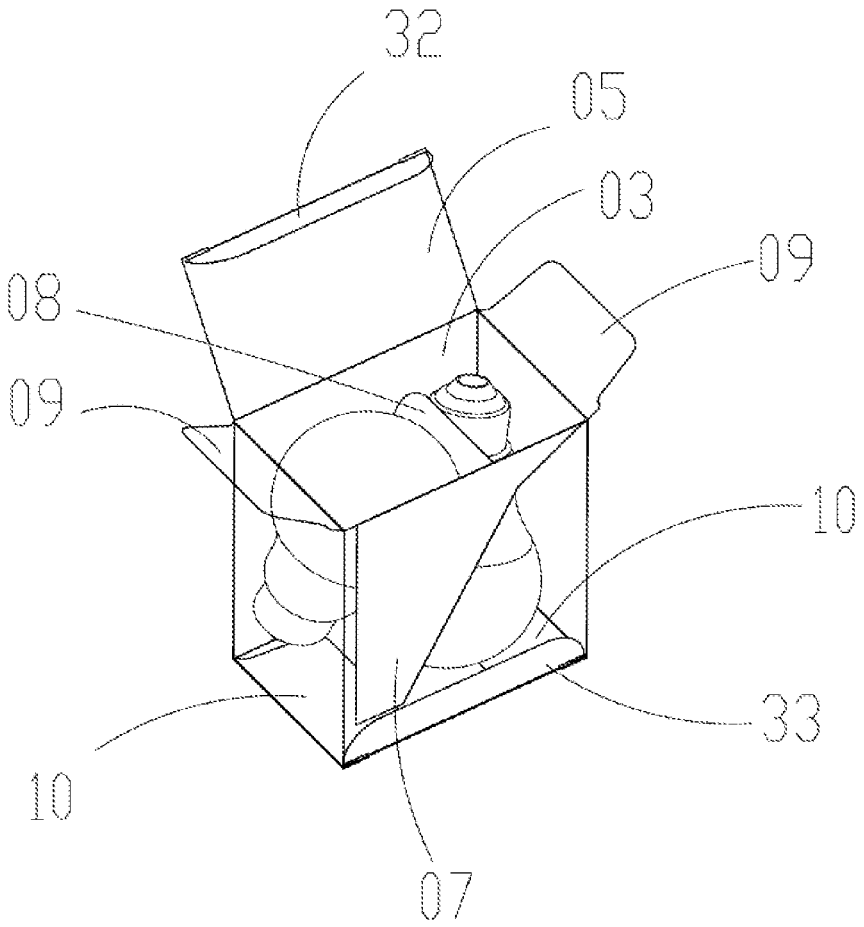
FIG. 10 illustrates a cross-sectional view of the example.

FIG. 10 shows a cross-sectional view how the light bulbs stored in the light device holder.

Reference numerals among different drawings refer to the same components and are not repeated for brevity.

FIG. 11 to FIG. 20 show another embodiment, in which four light bulbs may be stored in such light device holder.

Figure 11:
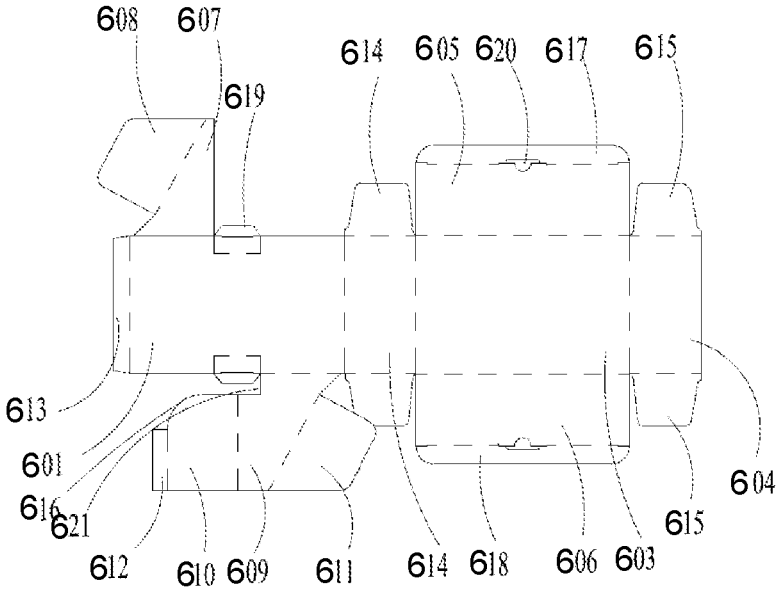
FIG. 11 illustrates an unfolded diagram of another embodiment.

FIG. 11 shows several areas 608, 607, 619, 614, 605, 620, 617, 615, 604, 615, 603, 606, 618, 614, 611, 609, 610, 612, 621, 616, 601 and 613.

Figure 12:
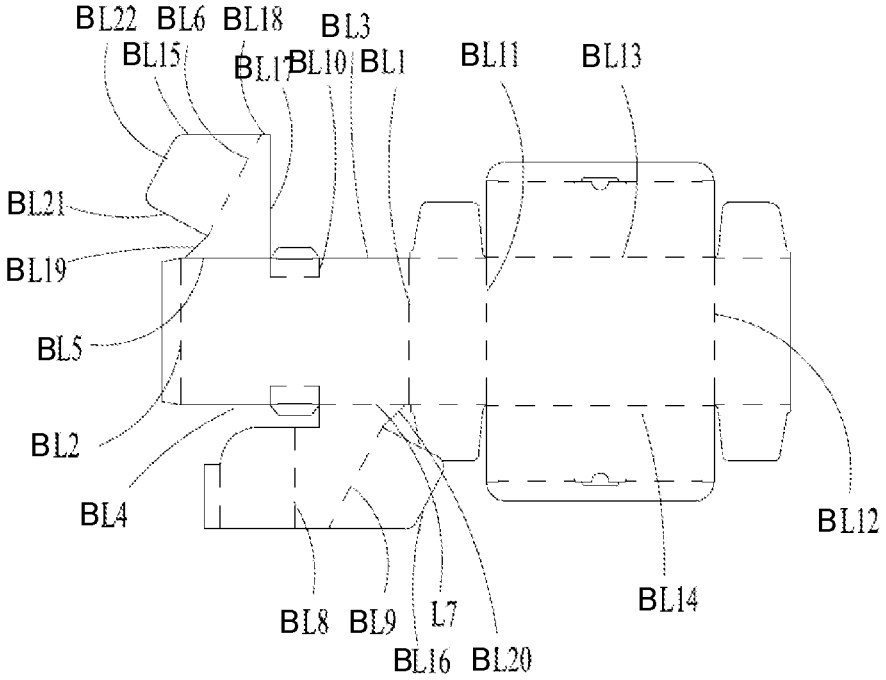
FIG. 12 illustrates another view of the example in FIG. 11.
Figure 13:
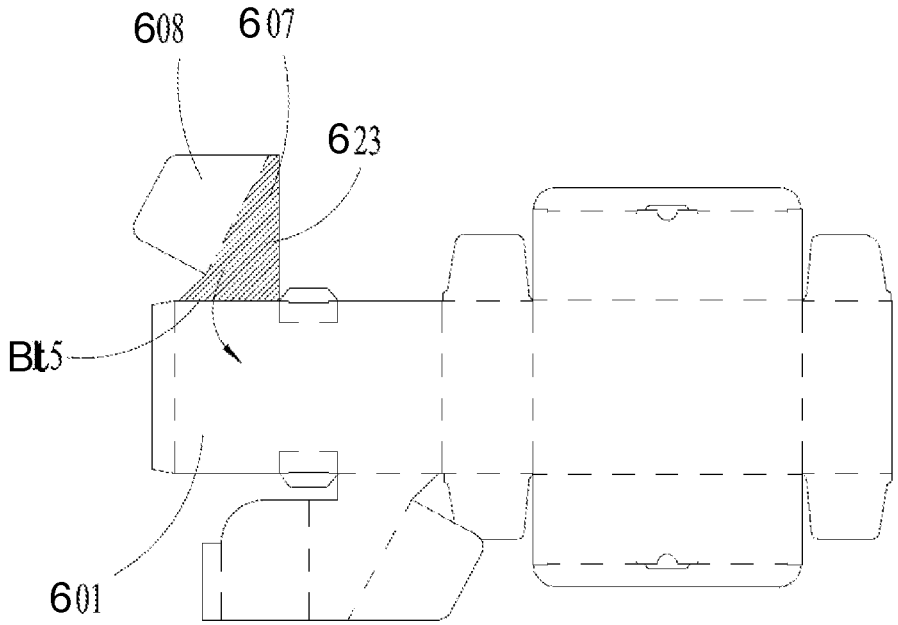
FIG. 13 illustrates a folding instruction for the example in FIG. 11.
Figure 14:
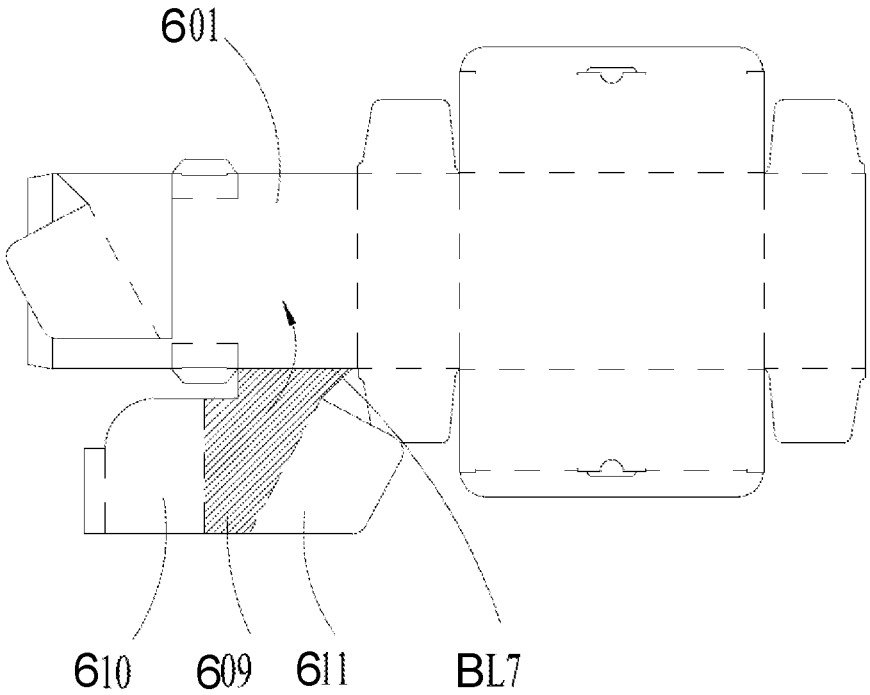
FIG. 14 illustrates a folding instruction for the example in FIG. 11.
Figure 15:
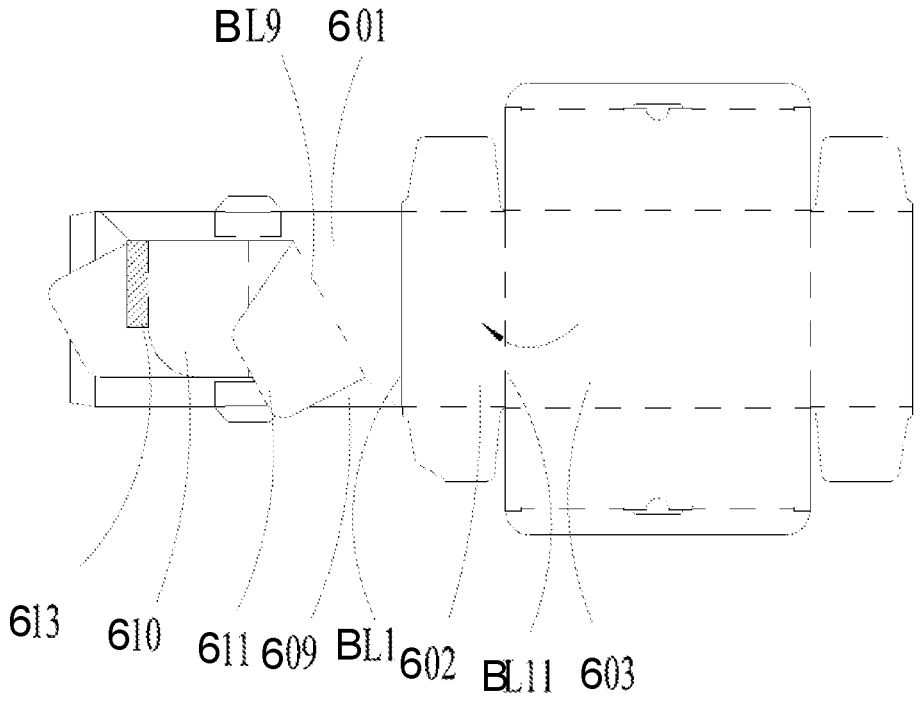
FIG. 15 illustrates a folding instruction for the example in FIG. 11.
Figure 16:
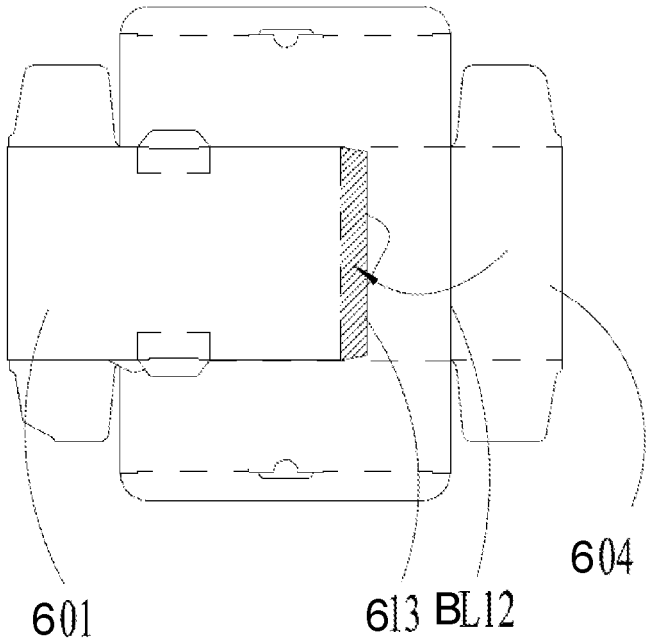
FIG. 16 illustrates a folding instruction for the example in FIG. 11.
Figure 17:
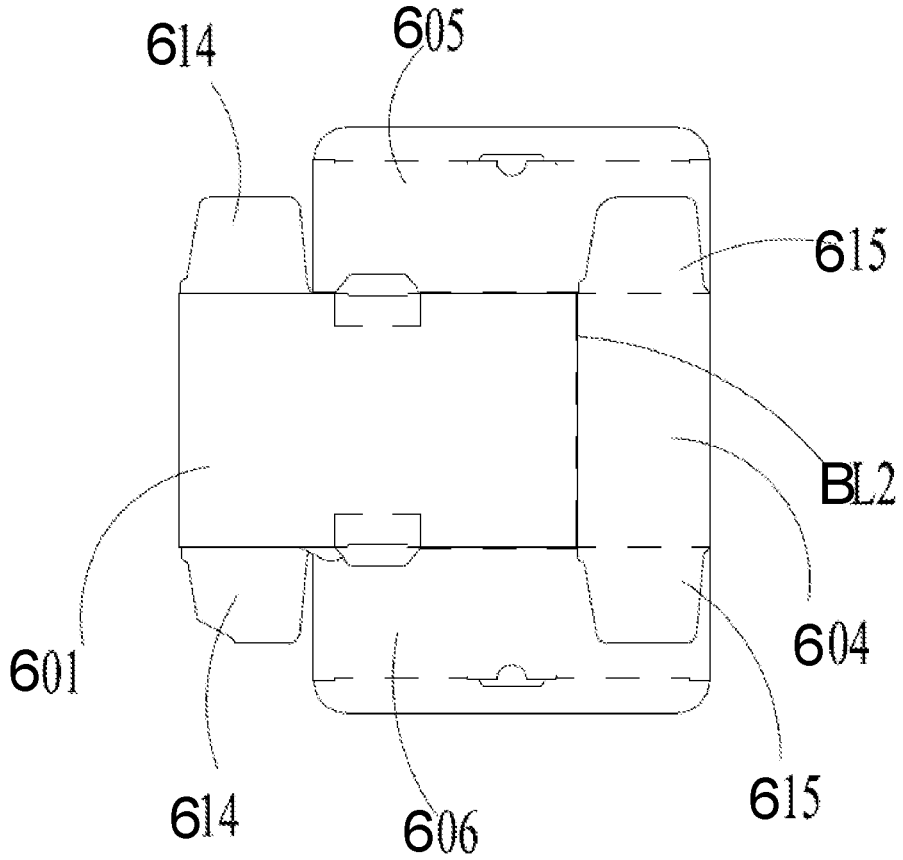
FIG. 17 illustrates a folding instruction for the example in FIG. 11
Figure 18:
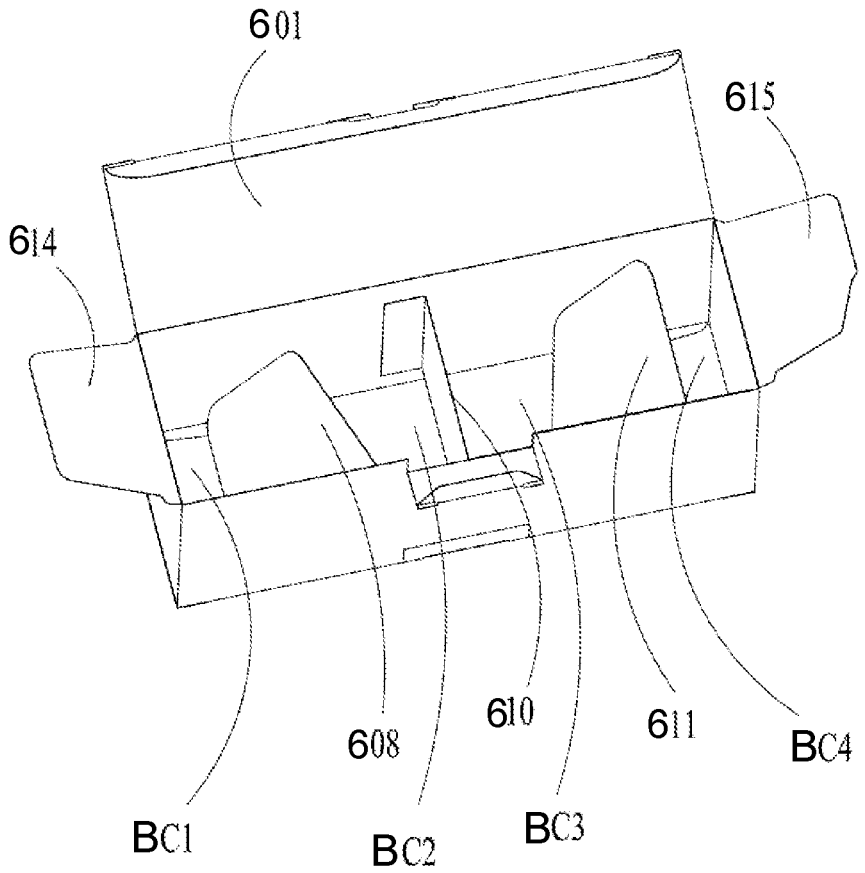
FIG. 18 illustrates a folded example ready for storing light bulbs.

FIG. 12 shows folding lines BL22, BL15, BL6, BL18, BL10, BL3, BL1, BL11, BL13, BL12, BL14, BL20, L7, BL16, BL8, BL4, BL2, BL5, BL19 and BL21.

FIG. 13 to FIG. 18 show the areas are folded along the folding lines.

Figure 19:
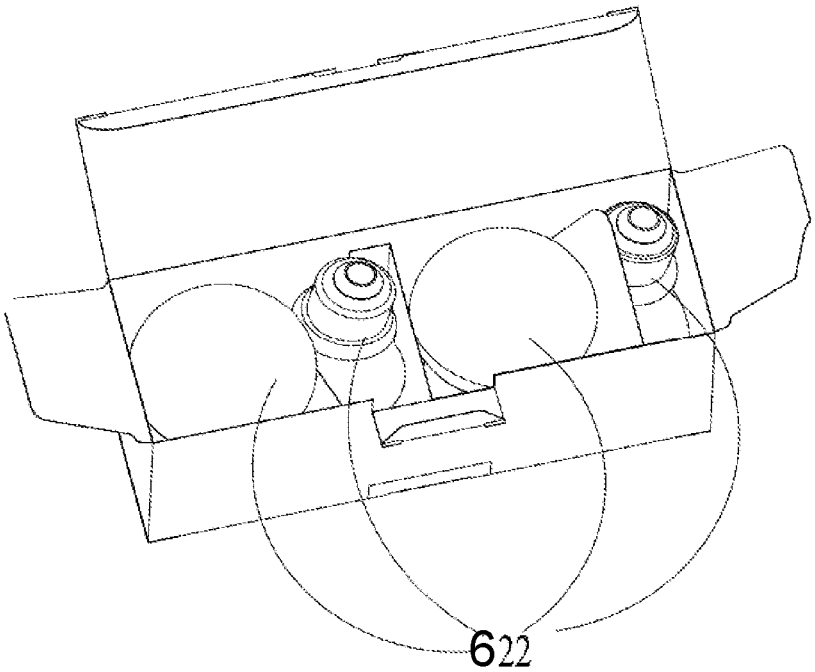
FIG. 19 illustrates a usage example showing light bulbs being stored.

FIG. 19 show light bulbs stored in such light device holder.

Figure 20:
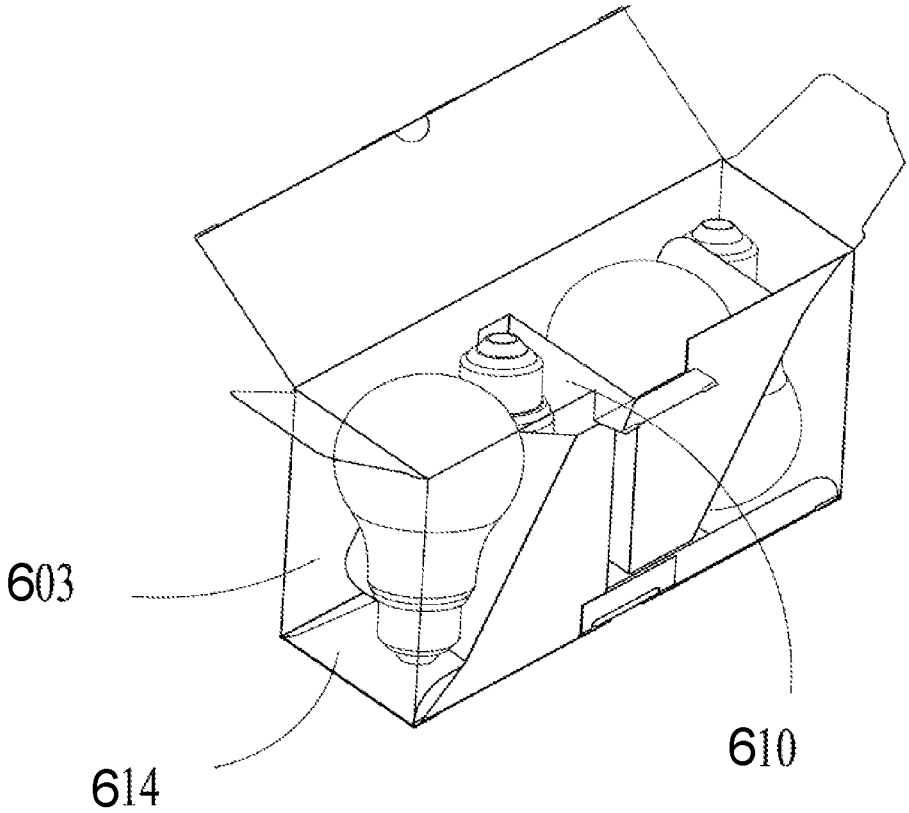
FIG. 20 illustrates a cross-sectional view of the example.

FIG. 20 shows a cross-sectional view of this example.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light device holder for containing and enclosing multiple light bulbs, comprising:

a first paper wall;

a second paper wall opposite to the first paper wall;

a first lateral wall;

a second lateral wall, wherein two sides of the first paper wall and the second paper wall are respectively connected to edges of the first lateral wall and the second lateral wall forming a rectangular container space;

a spacer plate having a first plate part and a second plate part, wherein the first plate part engages an inner surface of the first paper wall, the second plate part is folded from the first plate part to extend as a tilt surface to divide the rectangular container space into a first space part and a second space part, the first space part is symmetrical to the second space part for respectively storing two light bulbs, wherein an inner electrode is disposed on the second plate part for connecting electricity from an external electrode on an exterior surface of the first lateral wall for guiding an external power to turn on the light bulbs stored in the rectangular space, wherein an Edison socket is disposed on the second plate part for containing the inner electrode.

2. The light device holder of claim 1, wherein the two light bulbs stored in the first space part and the second space part are headed with opposition directions.

3. The light device holder of claim 2, wherein the first space part has a first end and second end, the first end has a larger diameter than the second end.

4. The light device holder of claim 3, wherein the second plate part is rotatable with respect to the first plate part to removing a second light bulb after the first light bulb is removed from the rectangular container space.

5. The light device holder of claim 1, wherein the first plate part is attached to the inner surface of the first paper wall with glue.

6. The light device holder of claim 5, wherein the first plate part has a triangle structure with two triangle sides aligning with two sides of the first paper wall.

7. The light device holder of claim 1, further comprising a top cover and a bottom cover, wherein the top cover and the bottom cover conceals the rectangular container space.

8. The light device holder of claim 7, wherein the top cover, the bottom cover, the first paper plate, the second paper plate, the first lateral wall, the second lateral wall and the spacer plate are all formed on a single paper sheet.

9. The light device holder of claim 8, wherein the first plate part and the second plate part are folded with 90 degree angles.

10. The light device holder of claim 8, wherein the first plate part is fixed with respect to the first paper plate to ensure the second plate part stable when storing the light bulbs.

11. The light device holder of claim 1, wherein the first paper wall has a transparent window to see the light bulbs stored in the rectangular container space.

12. The light device holder of claim 1, further comprising a second spacer plate with the same structure as the spacer plate for storing another two light bulbs.

13. The light device holder of claim 1, wherein an elastic layer is formed on a surface of the second plate part.

14. The light device holder of claim 1, wherein an adhesive layer is formed on a surface of the second plate part to decrease movement of the light bulbs.

15. The light device holder of claim 1, wherein the first lateral wall is made of a different material as the first paper wall.

16. The light device holder of claim 15, wherein the material of the first lateral wall has a strong rigidity than the first paper wall.

17. The light device holder of claim 1, wherein a trap hole is disposed on the second plate part for holding the light bulb.

18. The light device holder of claim 17, wherein the second plate part has a main part and an extending part with a folding angle with respect the main part.

* * * * *